US005429126A

United States Patent [19]

Bracken

[11] Patent Number: 5,429,126

[45] Date of Patent: Jul. 4, 1995

[54] RESPIRATORY MASK HEADSET ATTACHMENT

[76] Inventor: Mary R. Bracken, 25 Lawrence Rd., Scarsdale, N.Y. 10583

[21] Appl. No.: 220,446

[22] Filed: Mar. 30, 1994

[51] Int. Cl.[6] ..... A62B 18/08

[52] U.S. Cl. ..... 128/207.11; 128/201.22

[58] Field of Search ..... 128/201.22, 201.23, 128/201.24, 206.27, 206.28, 207.11, 206.21, 206.19

[56] References Cited

U.S. PATENT DOCUMENTS

| | | | |
|---|---|---|---|
| 1,395,759 | 11/1921 | Monro | 128/206.28 |
| 3,013,556 | 12/1961 | Galleher, Jr. | 128/207.11 |
| 3,082,767 | 3/1963 | Matheson | 128/207.11 |
| 5,038,776 | 8/1991 | Harrison et al. | 128/201.23 |
| 5,237,986 | 8/1993 | Seppala et al. | 128/201.23 |

FOREIGN PATENT DOCUMENTS

| | | | |
|---|---|---|---|
| 780746 | 5/1935 | France | 128/207.11 |
| 197189 | 5/1923 | United Kingdom | 128/201.23 |
| 2092009 | 8/1982 | United Kingdom | 128/206.21 |

*Primary Examiner*—Edgar S. Burr
*Assistant Examiner*—William J. Deane, Jr.
*Attorney, Agent, or Firm*—George T. Marcou

[57] ABSTRACT

A respiratory mask headset attachment to hold a respiratory mask snugly to the face of the user through the use of a single elastic band connected to the mask and a crown piece is disclosed. The elastic band creates two separate paths over the upper back portion of the user's head and is connected to the crown piece by two sleeves. A peg and hole connecting mechanism between the band and the mask is disclosed. Further, the band may be adjusted.

4 Claims, 3 Drawing Sheets

RESPIRATORY MASK HEADSET ATTACHMENT

BACKGROUND OF THE INVENTION

This invention relates to durable medical equipment and, more particularly, to a system and method for a secure fit of a respiratory face mask resulting in improved delivery of medication and/or oxygen.

It is necessary for individuals with respiratory disorders, such as asthma, allergies, cystic fibrosis and others, to use a nebulizer to deliver aerosolized medications to treat their condition. People who require respiratory treatments typically require multiple or frequent treatments each day, throughout the day. Depending upon the amount of medication to be delivered a single treatment could last 10–20 minutes or longer.

Currently this is performed by holding the respiratory mask to a person's face by hand. Alternatively, one may use a single strap of elastic, which is usually fit to the head and then passed into holes provided for said purpose on the sides of the mask. This results in an uncomfortable and poor fit. It also allows the mask to slip and shift, resulting in constant adjustments to secure the mask properly in place. It also can disrupt the delivery of the treatment, particularly in dealing with children, who are less likely to sit still and comply.

Another problem is that such a respiratory mask requires thorough cleaning after each use to avoid the possibility of contamination, which could lead to serious complications, particularly for a respiratory patient. By repeatedly removing and re-inserting the elastic ends in and out of the holes, the elastic ends become progressively worn, frayed and damaged making them unusable. As a result, after a few uses the elastic needs to be replaced.

As alluded to previously, another significant problem, faced primarily by a parent, caregiver or nurse, is that of dealing with a child who does not want to cooperate with the treatment. As indicated previously, the single elastic strap, because of it's inherent instability, does not enable a child to participate in any activity such as reading, coloring, playing, or the like during the course of the treatment. Attempts to participate in such activities usually results in the elastic falling to the back of the neck and adversely effecting the security of the mask and therefore the efficacy of the treatment. Likewise, the inherent instability also curtails what an older child or adult can accomplish during the lengthy and repetitive respiratory treatments each day.

SUMMARY AND OBJECTS OF THE INVENTION

It is an object of this invention to provide a secure, comfortable and snug fit of the respiratory mask while permitting increased mobility during the course of the treatment.

It is another object of the invention to enable a person to attach and remove the respiratory mask with ease and to remove and reinsert the elastic strap repeatedly without constant damage and frequent replacement.

In accordance with the foregoing objects, a respiratory mask headset attachment is disclosed. The attachment holds the mask snugly to the face of the user through the use of a single elastic band which is connected both to the mask and a crown piece. The elastic band creates two separate paths over the upper back portion of the user's head and is connected to the crown piece by two sleeves. A peg and hole connecting mechanism between the band and the mask is also disclosed. Further, the band is adjustable by a buckle to conform to the size and shape of the user's head.

Further objects and advantages of my invention will become apparent from a consideration of the drawings and ensuing descriptions thereof.

DETAILED DESCRIPTION OF THE DRAWINGS

The preferred embodiment of the invention will now be discussed.

Figure 1:
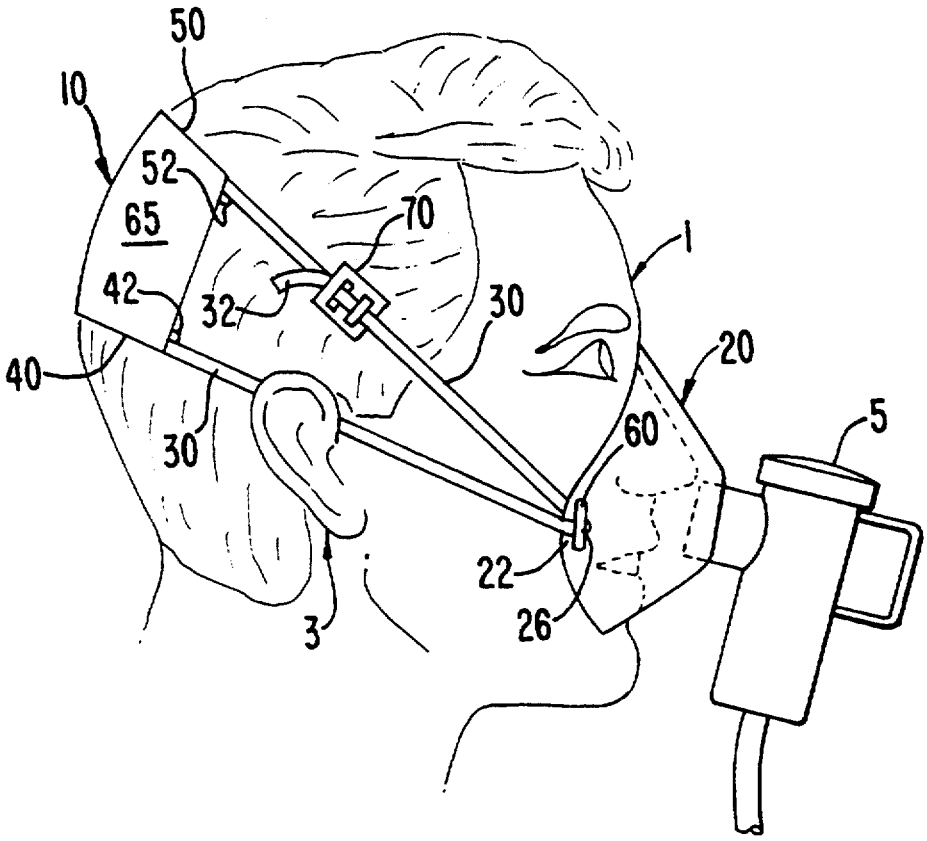
FIG. 1 is a side view of the respiratory mask headset attachment of the present invention.

In FIG. 1 a respiratory mask headset attachment 10 is shown snugly positioned onto the face of the user 1. Specifically, the mask 20 which is connected to conventional treatment apparatus 5 is snugly positioned on the face of the user 1 by the attachment 10. The attachment 10 includes an elastic band 30 which is connected to the mask 20 on either side by connecting means to be discussed below.

As seen in FIG. 1 the elastic band 30 is connected to mask 20 at first connecting portion 22 and extends just above the ear of the user 1 along the upper back portion of the head of the user 1 creating a first path 40 across the back of the head of user 1. The band 30 extends along the first path 40 until it is connected with the mask 20 at a second connecting portion 24, on the opposite side of the mask 20 from the first connecting portion 22 (see FIG. 2), in a manner to be discussed below. The elastic band 30 then once more extends away from the mask 20 along the upper back portion of the head of the user 1. However, during this portion the band 30 extends further up the head of the user thereby creating a second path 50. The band 30 is then once more connected to the first connecting portion 22 of the mask 20.

Thus, a single elastic band creates two separate paths 40 and 50, respectively, along the upper back portion of the head of the user 1. Further, the band is connected at two opposite portions 22 and 24, respectively, of the mask 20.

During a portion of the paths 40 and 50, the band 30 run through sleeves 42 and 52 respectively on the crown piece 65. The function of crown piece 65 is to properly space the first and second paths 40 and 50 apart from one another so that a triangular shape is formed between the two paths 40 and 50 of the band 30 and the back of the head of the user 1 when viewed in profile (see FIG. 1). This triangularity ensures a snug positioning of the mask 20 against the face of the user 1. Another function of crown piece 65 is to assure that the force of the tension of the band 30 is distributed uniformly across the back upper portion of the head of the user 1 so that the wearing of the attachment 10 is comfortable.

As also seen in FIG. 1 an adjustment mechanism, such as a buckle 70, is used to customize the fit of attachment 10 to the size and shape of the head of the user 1. The adjustment mechanism of buckle 70 is well known in the art and any suitable adjustment mechanism may be used. Because only a single elastic band is required and because the band 30 may be played through the connecting mechanisms to the mask 20 as described more fully below, through use of the buckle 70 the length of both paths 40 and 50 may be adjusted. Further, because the band 30 goes through sleeves 42 and 52 in the crown piece 65, once the length of the band 30 has been adjusted by buckle 70, the crown piece 65 may be moved with respect to band 30 (e.g., the cord 30 slid along the sleeves 42 and 52) to ensure a customized fit. The sleeves 42 and 52 may be created by stitching a portion of crown piece 65 back on itself or by any other appropriate connecting means. Also, the excess portion of band 30 extending out of the buckle 70, shown as portion 32 in FIG. 1, may be cut-off or tucked underneath the crown piece 65.

Figure 3:
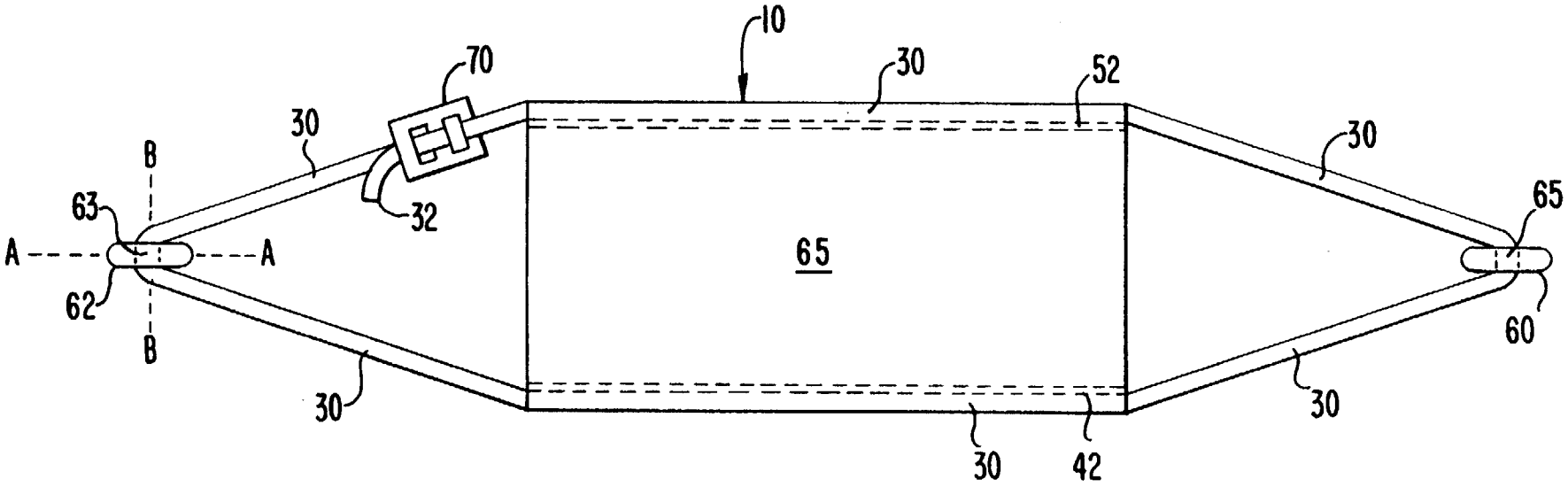
FIG. 3 is plan view of the attachment of FIG. 1.

The construction of the attachment 10 is also shown in FIG. 3. As can be seen in FIG. 3 a single elastic band 30 is used in the construction of attachment 10. The band 30 is connected to the crown piece 65 through sleeves 42 and 52 so that, due to the tension in the band 30 and the curvature of the head of the user 1, a predetermined distance is maintained between the portions of the paths 40 and 50 within sleeves 42 and 52 connected to crown piece 65.

Without the crown piece 65 the band 30 along the first path 40 may tend to shift down to the neck of the user and thereby reduce tension in the band 30. Conversely, without the crown piece 65 the portion of the band 30 along the second path 50 may tend to ride up on the head of the user 1 and thereby reduce the tension in the band 30. In both cases mentioned above, the reduction in tension in the band 30 will result in a less stable and less snug positioning of the mask 20 against the face of the user 1. Thus, crown piece 65 contributes to a snug fit.

Further, FIG. 3 shows pegs 60 and 62 which are generally cylindrically shaped. The elastic band 30 is passed through the openings 61 and 63 of the pegs 60 and 62, respectively. The openings 61 and 63 extend through the pegs 60 and 62 along a short axis of the generally cylindrical pegs 60 and 62. As shown in FIG. 3, the long axis of the generally cylindrical peg 62 is designated as A and the short axis is designated as B.

Figure 2:
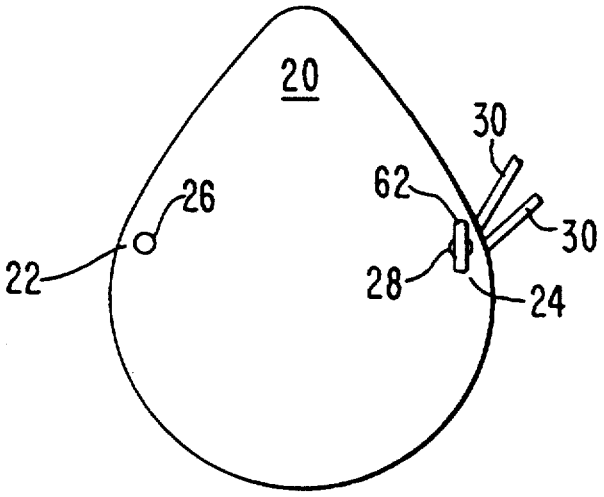
FIG. 2 is a front view of the mask of FIG. 1.
Figure 4A:
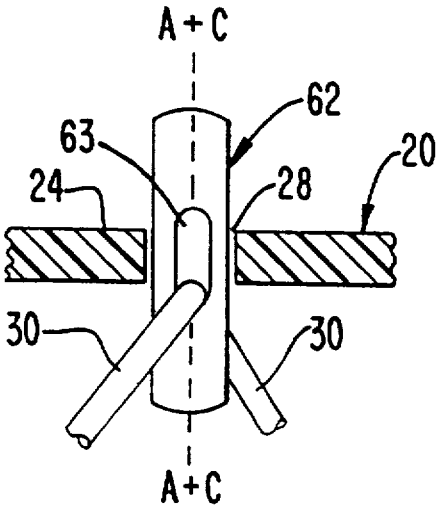
FIG. 4A is partial cross-sectional view of the peg and hole connecting mechanism of the attachment of FIG. 1.

The connecting means to connect the attachment 10 to the mask 20 will now be described. As shown in FIG. 2, the mask 20 has first hole 26 and second hole 28 positioned opposite one another on the connecting portions 22 and 24. As shown in FIG. 4A the diameter of the generally cylindrically shaped peg 62 is sized small enough so that it may move along its long axis A through the hole 28 in the second connecting portion 24 of the mask 20. Specifically, the hole 28 is large enough so that the peg 62 along with the cord 30 which is passed through the opening 63 of the peg 62 may be pushed from the inner surface of the mask 20 through the hole 28 to the outer surface of the mask 20. During this movement, the long axis A of peg 62 generally aligns with the axis C of the hole 28.

Figure 4B:
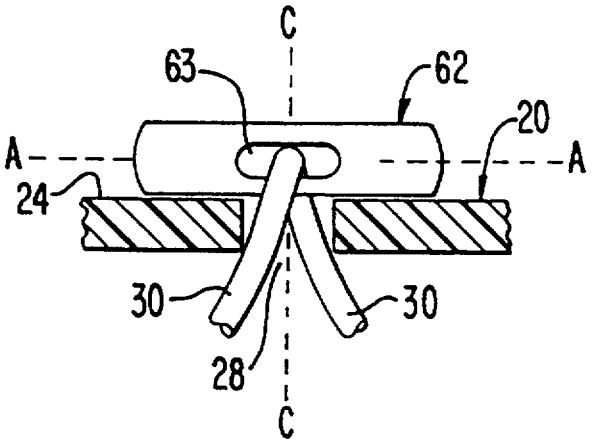
FIG. 4B is another partial cross-sectional view of the peg and hole connecting mechanism of the attachment of FIG. 1.

Once the peg 62 and connected cord 30 is pushed through the hole 28, as shown in FIG. 4B the peg 62 is rotated so that its long axis A is essentially perpendicular to the axis C of the hole 28. At this point the peg 62 is released and the tension in the elastic band 30 against the opening 63 in the peg 62 pulls the peg 62 against the outer surface of the mask 20. Thus, the band 30 is connected to the connecting portion 24 of the mask 20. To remove the mask the user simply reverses the steps and pushes the peg 62 back through the hole 28. A similar connecting mechanism is used for connecting peg 60 to the first connecting portion 22 (see FIG. 1).

Accordingly, a simple way to connect the mask to the attachment 10 is achieved. Further, wear and tear on the elastic band 30 is minimized. Once a portion of band 30 becomes frayed due to its being rubbed by the pegs 60 and 62 (see FIGS. 4A and 4B), the user need simply slide the band 30 through the openings 61 and 63 and the sleeves 42 and 52 to bring a new, unfrayed portion of the band 30 into use to connect the mask 20 to the attachment 10.

With regard to materials, the band 30 may be made of cloth, elastic material, plastic or any other suitable material. Similarly, the crown piece 65 may be made of any suitable material, including cloth or plastic. The pegs 60 and 62 may be made of any suitable material, including plastic or metal.

Although it has been illustrated and described in the particular embodiment of the present invention, it will be appreciated that numerous changes and modifications will occur to those skilled in the art and it is intended in the appended claims to cover all those changes and modifications which fall within the true spirit and scope of the present invention.

What is claimed as new and desired to be secured by Letters Patent of the United States is:

1. A respiratory mask headset attachment for snugly positioning said mask for use on the head of a user comprising:

a mask positioned onto a face of a user said mask having a first connecting portion on one side of said mask and a second connecting portion on the opposite side of said mask;

an elastic band having two ends joined together to form a closed loop and carrying a first and second connecting means to connect said band to said mask, said elastic band being connected to said first connecting portion of said mask by said first connecting means and extending along the upper back surface of a head by a first path to said second connecting portion of said mask wherein said band is connected to said mask by said second connecting means; and further wherein said band extends back along said upper back surface of a head by a second path to said first connecting portion of said mask when said band is once more connected to said mask by said first connecting means;

a crown piece through which said band passes having at least two edges such that said band passes through the first edge of said crown piece along said first path and through the second edge of said crown piece along said second path such that the crown piece may be moved relative to said band and such that, due to the tension in the band and the curvature of a head of a user, said first edge and second edge of said crown piece are spaced apart a predetermined distance on the upper back surface of a head;

and further wherein said first and second connecting means each comprise a generally cylindrically shaped peg having a long axis and a short axis generally perpendicular thereto, and an opening substantially along said short axis through which the band extends;

and further wherein said first and second connecting portions of said mask comprise holes having an axis and sized large enough so that said pegs may be extended through said holes along said long axis of the peg and small enough so that said peg will not pass through said hole when said peg is positioned with its long axis perpendicular to the axis of said hole; and said openings of said pegs being sufficiently large such that said band may be moved through said openings and repositioned relative to said pegs and said crown piece such that once sections of the band become worn due to contact with the pegs in use, the band may be moved through said openings and repositioned relative to said pegs and said crown piece so that unworn sections of the band are brought into contact with said pegs.

2. The attachment of claim 1 wherein the length of said band is adjustable.

3. The attachment of claim 1 wherein said crown piece is made of cloth.

4. The attachment of claim 1 wherein said band passes through sleeves in said crown piece.

* * * * *